US007369092B1

(12) United States Patent
Wen et al.

(10) Patent No.: US 7,369,092 B1
(45) Date of Patent: May 6, 2008

(54) MOBILE WIRELESS COMMUNICATIONS DEVICE WITH MULTIPLE RF TRANSCEIVERS USING A COMMON ANTENNA AT A SAME TIME AND RELATED METHODS

(75) Inventors: Geyi Wen, Waterloo (CA); Qinjiang Rao, Waterloo (CA); Shirook Ali, Mississauga (CA); Mark Pecen, Waterloo (CA)

(73) Assignee: Research in Motion Limited, Ontario (CA)

( * ) Notice: Subject to any disclaimer, the term of this patent is extended or adjusted under 35 U.S.C. 154(b) by 0 days.

(21) Appl. No.: 11/551,284

(22) Filed: Oct. 20, 2006

(51) Int. Cl.
*H01Q 1/24* (2006.01)
*H01Q 1/38* (2006.01)

(52) U.S. Cl. ..... 343/702; 343/700 MS; 455/90.3; 455/82

(58) Field of Classification Search ..... 343/700 MS, 343/702, 767, 770; 455/82, 90.3, 277.1
See application file for complete search history.

(56) References Cited

U.S. PATENT DOCUMENTS

| | | | | |
|---|---|---|---|---|
| 5,241,321 | A | 8/1993 | Tsao | 343/700 MS |
| 5,969,681 | A * | 10/1999 | O'Neill, Jr. | 343/700 MS |
| 6,313,801 | B1 * | 11/2001 | Sanford et al. | 343/725 |
| 6,329,951 | B1 | 12/2001 | Wen et al. | 343/702 |
| 6,559,811 | B1 | 5/2003 | Pulimi et al. | 343/985 |
| 6,662,028 | B1 | 12/2003 | Hayes et al. | 455/575.7 |
| 6,989,794 | B2 | 1/2006 | Tran | 343/702 |
| 7,023,387 | B2 | 4/2006 | Wen et al. | 343/700 MS |
| 7,233,291 | B2 * | 6/2007 | Elkobi et al. | 343/702 |
| 2006/0178116 | A1 * | 8/2006 | Qi et al. | 455/90.3 |
| 2007/0085747 | A1 * | 4/2007 | DiNallo et al. | 343/702 |

FOREIGN PATENT DOCUMENTS

| | | |
|---|---|---|
| EP | 1398875 | 3/2004 |
| EP | 1498984 | 1/2005 |
| WO | WO02/078123 | 10/2002 |
| WO | WO03/094346 | 11/2003 |

* cited by examiner

*Primary Examiner*—Tan Ho
(74) *Attorney, Agent, or Firm*—Allen, Dyer, Doppelt, Milbrath & Gilchrist, P.A.

(57) ABSTRACT

A mobile wireless communications device may include a housing and a common antenna carried by the housing and having a plurality of spaced apart signal feed points thereon. The device may further include a plurality of wireless radio frequency (RF) transceivers carried by the housing and coupled to respective ones of the signal feed points of the common antenna. Each wireless RF transceiver may also have a respective different operating frequency associated therewith. Furthermore, the device may also include a controller selectively operating at least some of the wireless RF transceivers to advantageously use the common antenna at a same time.

25 Claims, 12 Drawing Sheets

MOBILE WIRELESS COMMUNICATIONS DEVICE WITH MULTIPLE RF TRANSCEIVERS USING A COMMON ANTENNA AT A SAME TIME AND RELATED METHODS

FIELD OF THE INVENTION

The present invention relates to the field of communications devices, and, more particularly, to mobile wireless communications devices and related methods.

BACKGROUND OF THE INVENTION

Cellular communications systems continue to grow in popularity and have become an integral part of both personal and business communications. Cellular telephones allow users to place and receive voice calls most anywhere they travel. Moreover, as cellular telephone technology has increased, so too has the functionality of cellular devices and the different types of devices available to users. For example, many cellular devices now incorporate personal digital assistant (PDA) features such as calendars, address books, task lists, etc. Moreover, such multi-function devices may also allow users to wirelessly send and receive electronic mail (email) messages and access the Internet via a cellular network and/or a wireless local area network (WLAN), for example.

Even so, as the functionality of cellular communications devices continues to increase, so too does the demand for smaller devices which are easier and more convenient for users to carry. One challenge this poses for cellular device manufacturers is designing antennas that provide desired operating characteristics within the relatively limited amount of space available for the antenna. This is particularly true where multi-frequency band operation is required. Some wireless communications devices use multiple antennas to cover multiple radio frequency (RF) bands. Thus, as the number of operating frequency bands increases, so to does the number of antennas that are required. As a result, it may not be possible to include all of the antennas required to provide operation in all desired frequency bands in some embodiments due to such space constraints.

When the number of operating frequency bands is fairly small, some conventional mobile wireless communications devices will use a single antenna to cover the frequency bands. Yet, in such devices it may be difficult to obtain a desirable match and antenna gain over all of the frequency bands, and some trade-offs may need to be made between the frequency bands.

One example of a single antenna system used for operating over multiple frequency bands is disclosed in U.S. Pat. No. 6,662,028 to Hayes et al. This patent is directed to a planar inverted-F antenna for communications devices, such as radiotelephones, that radiates within multiple frequency bands. Multiple signal feeds extend from a conductive element in respective spaced-apart locations. A respective plurality of micro-electromechanical system (MEMS) switches are electrically connected to the signal feeds and are configured to selectively connect the respective signal feeds to ground or RF circuitry. In addition, each MEMS switch can be opened to electrically isolate a respective signal feed.

Such antennas may be advantageous for operating over different frequency bands at different times, and over a relatively small range of operating frequencies. Nonetheless, there may be applications in which it is desirable to provide multi-frequency operation at the same time and over a fairly large range of frequencies but while still providing a relatively compact antenna configuration suitable for use in handheld wireless communications devices.

DETAILED DESCRIPTION OF THE PREFERRED EMBODIMENTS

The present description is made with reference to the accompanying drawings, in which preferred embodiments are shown. However, many different embodiments may be used, and thus the description should not be construed as limited to the embodiments set forth herein. Rather, these embodiments are provided so that this disclosure will be thorough and complete. Like numbers refer to like elements throughout, and prime notation is used to indicate similar elements in different embodiments.

Generally speaking, a mobile wireless communications device is disclosed herein which may include a housing and a common antenna carried by the housing and having a plurality of spaced apart signal feed points thereon. Moreover, the device may further include a plurality of wireless radio frequency (RF) transceivers carried by the housing and coupled to respective ones of the signal feed points of the common antenna. Each wireless RF transceiver may also have a respective different operating frequency associated therewith. Furthermore, the device may also include a controller selectively operating at least some of the wireless RF transceivers to advantageously use the common antenna at a same time.

The device may also include a dielectric substrate carried within the housing, and the common antenna may comprise at least one conductive trace on the dielectric substrate. The common antenna may also have a reference voltage feed point. Furthermore, the common antenna may comprise a patch antenna having at least one slot therein. More particularly, the patch antenna may have a generally rectangular perimeter. By way of example, the at least one slot may include a plurality of slots defining an exterior common antenna portion and an interior common antenna portion therein. As such, at least one of the signal feed points may be on the interior common antenna portion, and/or at least one of the signal feed points may be on the exterior common antenna portion.

At least one of the wireless RF transceivers may be a cellular transceiver, for example. Also by way of example, the different operating frequencies may be within a range of about 900 MHz to 6 GHz. Further, the different operating frequencies have different user functions associated therewith. More specifically, the different user functions may include at least one of voice communication, email reception, email transmission, data reception, and data transmission, for example.

Figure 1:
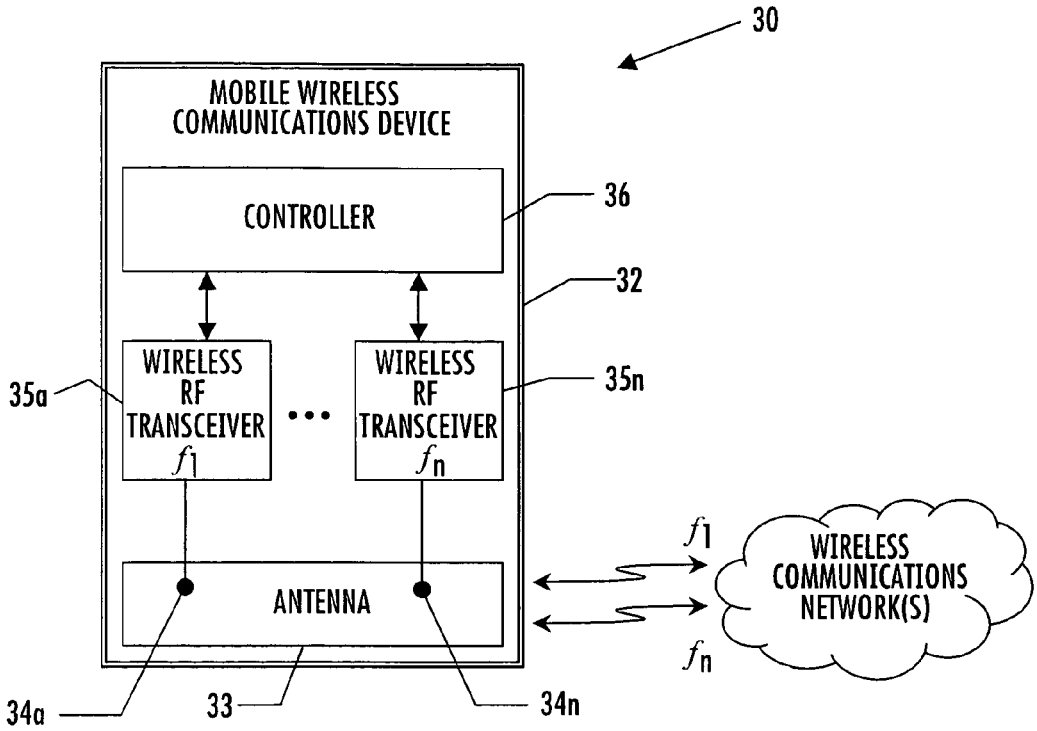
FIG. 1 is a schematic block diagram of a mobile wireless communications device in accordance with one exemplary embodiment.
Figure 2:
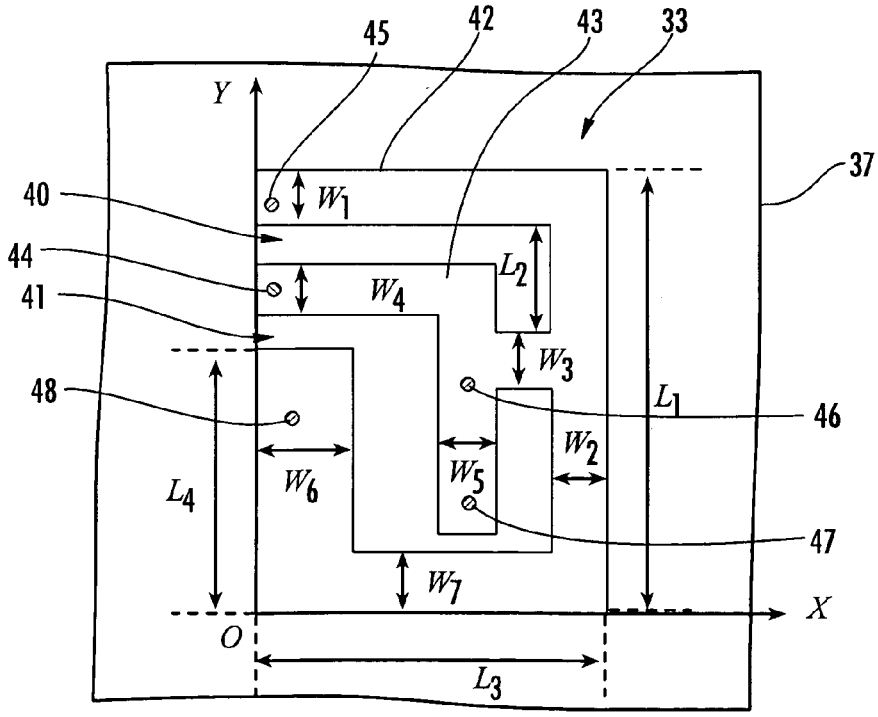
FIG. 2 is a top view of an exemplary patch antenna for use in the wireless communications device of FIG. 1.

Referring initially to FIGS. 1 and 2, a mobile wireless communications device 30 for communicating with one or more communications networks 31 illustratively includes a housing 32 and a common antenna 33 carried by the housing. By way of example, the wireless communications network(s) 31 may be a cellular network and/or wireless local area network (LAN), for example. The common antenna 33 illustratively includes a plurality of spaced apart signal feed points 34*a*-34*n* thereon.

The antenna 33 is "common" in the sense that it is shared by a plurality of wireless radio frequency (RF) transceivers 35*a*-35*n* (e.g., cellular and/or wireless LAN transceivers) also carried by the housing 32 and coupled to respective ones of the signal feed points 34*a*-34*n* of the common antenna 33. Each wireless RF transceiver preferably has a respective different operating frequency associated therewith, as will be discussed further below. Furthermore, the device 30 may also include a controller 36 that selectively operates at least some (i.e., two or more) of the wireless RF transceivers 35*a*-35*n* to advantageously use the common antenna 33 at a same time. As used herein, "at the same time" does not mean start and/or stop times are synchronized, but rather merely that there is some overlap in time. Although, it should be noted that the controller 36 need not operate multiple transceivers 35 at all times, i.e., the controller may in some instances operate only one transceiver at a time, as will be appreciated by those skilled in the art.

The device 30 also illustratively includes a dielectric substrate 37 (FIG. 2), such as a printed circuit board (PCB), carried within the housing 32, and the common antenna 33 may include at least one conductive trace on the dielectric substrate, as will be appreciated by those skilled in the art. Typically the controller 36 and wireless RF transceivers 35*a*-35*n* will also be carried by the dielectric substrate 37, as may other components such as a display, keypad, etc., which will be discussed further below. However, it should be noted that the common antenna 33 need not be carried on the same PCB with the wireless EF transceivers 35*a*-35*n* and/or controller in all embodiments, and may instead be carried on a retainer frame extension of the PCB, or otherwise mounted adjacent the PCS within the housing, as will be appreciated by those skilled in the art.

In accordance with one embodiment, the common antenna 33 may be a substantially linear antenna (e.g., inverted F antenna, monopole, etc.). In the embodiment illustrated in FIG. 2, the common antenna 33 is a patch antenna having first and second slots 40, 41 defining an exterior common antenna portion 42 and an interior common antenna portion 43 therein. It should be noted that a single slot or more than two slots may be used in other embodiments. As seen in the illustrated example, the common patch antenna 33 has a generally rectangular perimeter with length and width dimensions $L_1$, $L_3$, although other shapes are also possible.

In the exemplary embodiment, the common patch antenna 33 has a single reference voltage (e.g., ground) point 44, and four signal feed points 45-48. The reference voltage point 44, along with the third and fourth signal feed points 47, 48, are positioned on the interior common antenna portion 43, while the first and second feed points 45, 46 are positioned on the exterior common antenna portion 42 as shown in FIG. 2. However, other placements and numbers of feed points are also possible, including multiple reference voltage or ground points 44. Additionally, in some embodiments one or more of the signal feed points 45-48 could also be selectively coupled to a reference voltage/ground.

The first and second slots 40, 41 also define a plurality of leg portions defined by widths $W_1$-$W_7$ and lengths $L_2$ and $L_4$ that may advantageously be selected to tune the desired operating frequencies of the antenna 33. Some of the leg portions may be substantially related to a given operating frequency band, while other structures may influence multiple operating frequency bands, as will be appreciated by those skilled in the art.

The common antenna 33 advantageously provides a single multi-feed antenna that may be used instead of a plurality of different antennas as in some conventional handsets to provide multi-frequency band operation. This may provide advantages such as space savings, simplification of the handset design, and avoidance of electromagnetic interference (EMI) problems that are often associated with using multiple antennas in close proximity to one another.

Turning now to FIGS. 3 through 18, simulated operating characteristics of one implementation of the above-noted patch antenna configuration will now be presented. It should be noted that the patch structure used in the simulations has slightly different dimensions than the general shape illustrated in FIG. 2. Dimensions of the patch antenna structure used in the simulations are provided in Table 1, below.

TABLE 1

| Dimension | Value (mm) |
|---|---|
| $L_1$ | 41 |
| $L_2$ | 4.9 |
| $L_3$ | 14 |
| $L_4$ | 7 |
| $W_1$ | 3 |
| $W_2$ | 3 |
| $W_3$ | 2.8 |
| $W_4$ | 3 |
| $W_5$ | 3.1 |
| $W_6$ | 5.5 |
| $W_7$ | 4 |

By way of example, the different operating frequencies in the present example are within a range of about 900 MHz to 6 GHz, although other frequencies may also be used. The different operating frequencies have different user functions associated therewith. That is, certain of the operating frequencies may be used for one or more of voice communications (i.e., cellular phone calls) and data communications, such as Internet or electronic mail (email) data communication, as will be appreciated by those skilled in the art.

Figure 3:
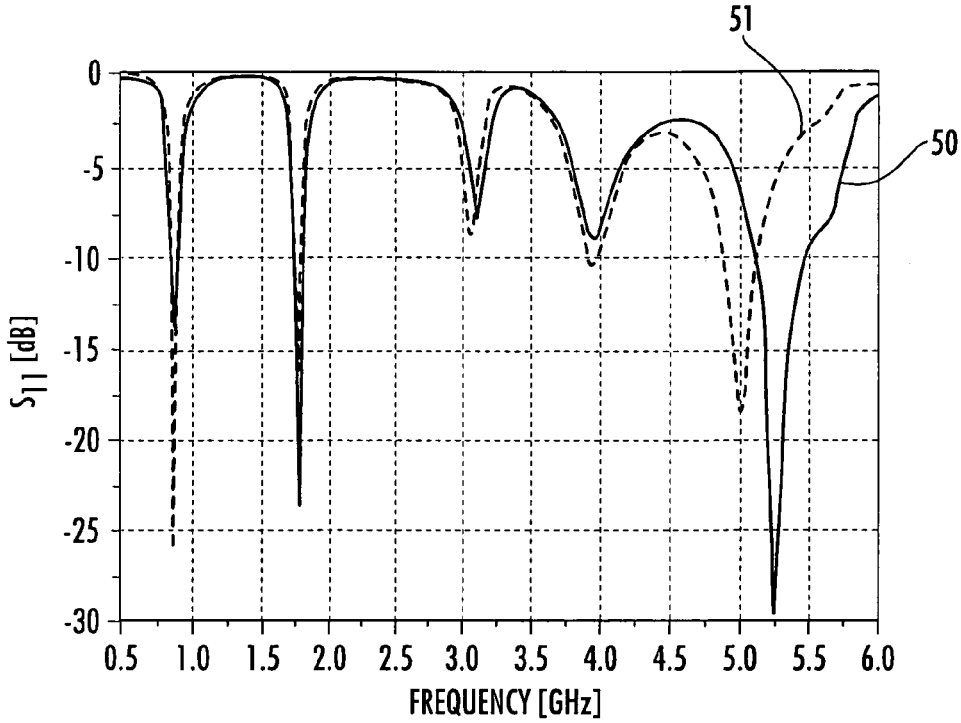
FIG. 3 is a graph of return loss vs. frequency associated with a first feed point of one implementation of the antenna of FIG. 3.
Figure 4:
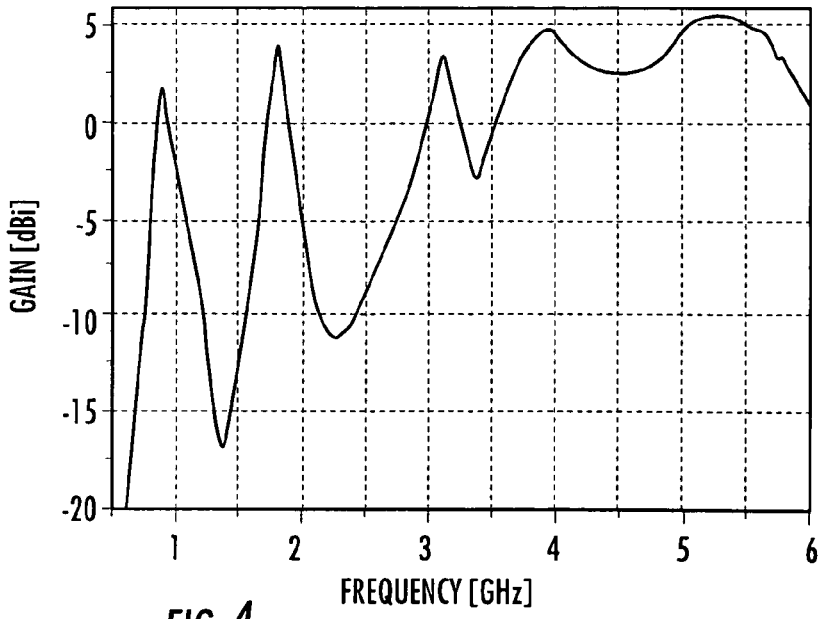
FIG. 4 is a graph of gain vs. frequency associated with the first feed point of the antenna of FIG. 3.
Figure 5A:
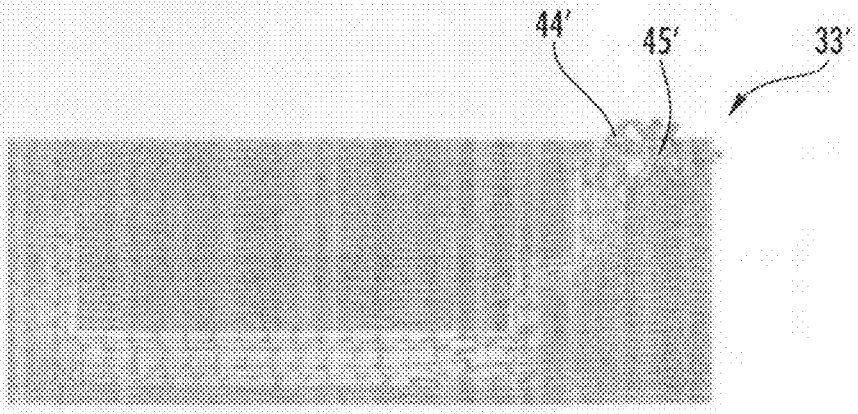
FIGS. 5A-5C are top views of the antenna of FIG. 3 illustrating simulated current distributions at 900 MHz, 1800 MHz, and 5 GHz, respectively, using the first signal feed point.
Figure 5B:
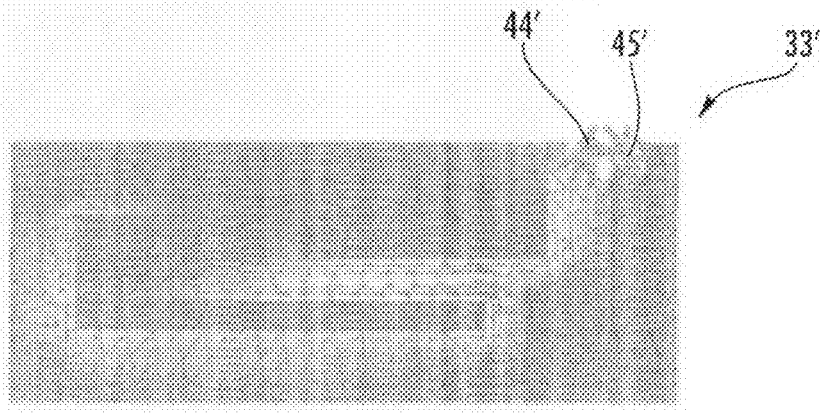
Figure 5C:
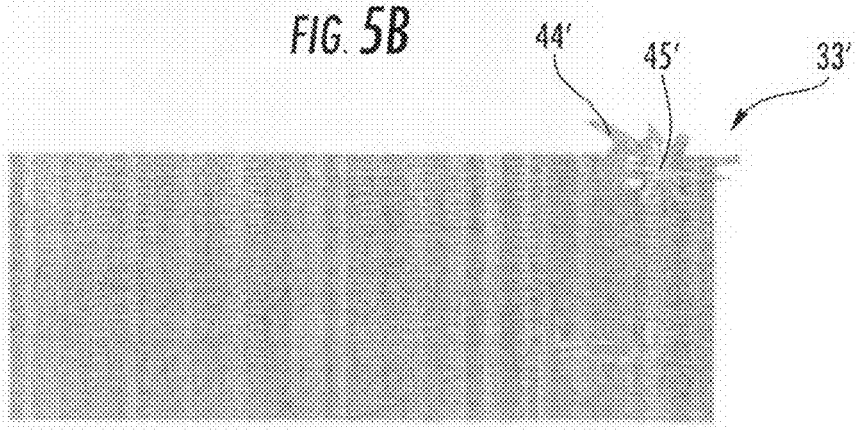
Figure 6A:
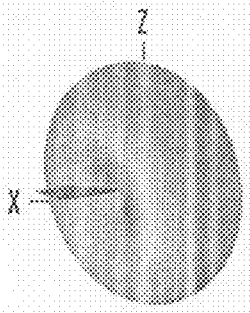
FIGS. 6A-6C are graphs of simulated antenna radiation patterns for the antenna of FIG. 3 at 900 MHz, 1800 MHz, and 5 GHz, respectively, using the first signal feed point.
Figure 6B:
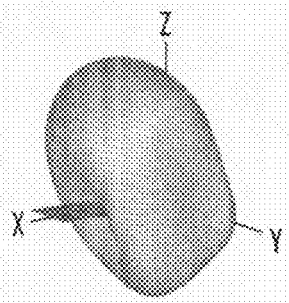
Figure 6C:
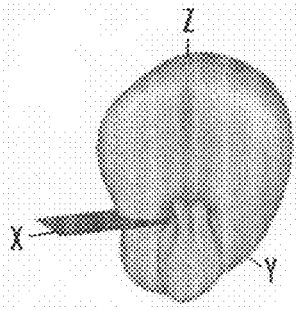
Figure 7:
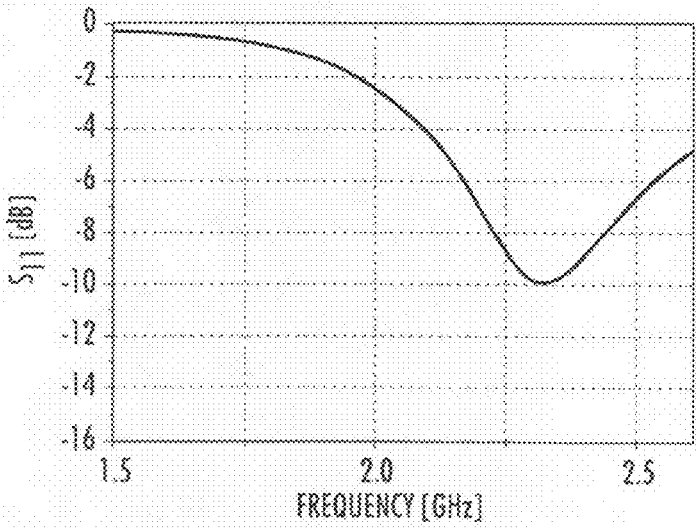
FIG. 7 is a graph of return loss vs. frequency associated with a second feed point of the antenna of FIG. 3.
Figure 8:
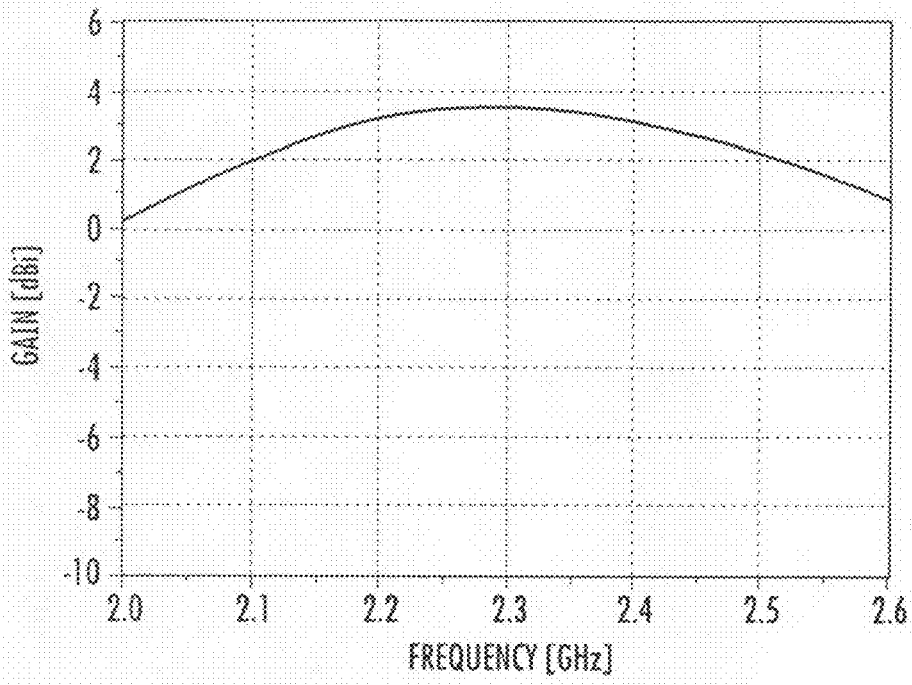
FIG. 8 is a graph of gain vs. frequency associated with the second feed point of the antenna of FIG. 3.
Figure 9:
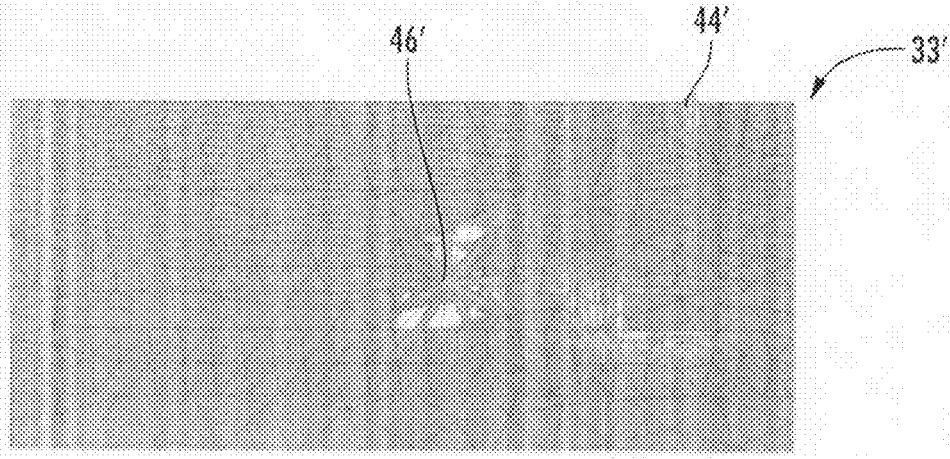
FIG. 9 is a top view of the antenna of FIG. 3 illustrating simulated current distribution at 2.45 GHz using the second signal feed point.
Figure 10:
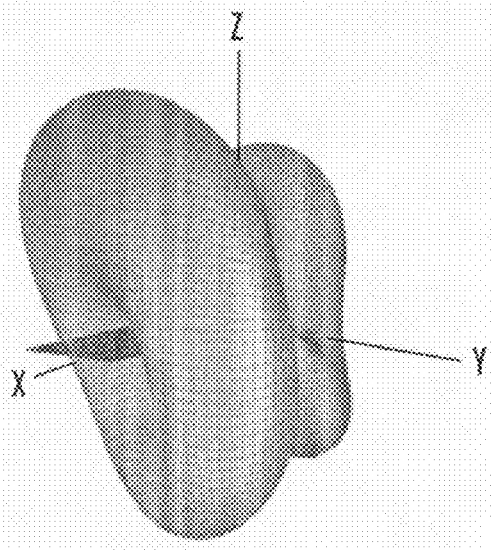
FIG. 10 is a graph of a simulated antenna radiation pattern for the antenna of FIG. 3 at 2.45 GHz using the second signal feed point.
Figure 11:
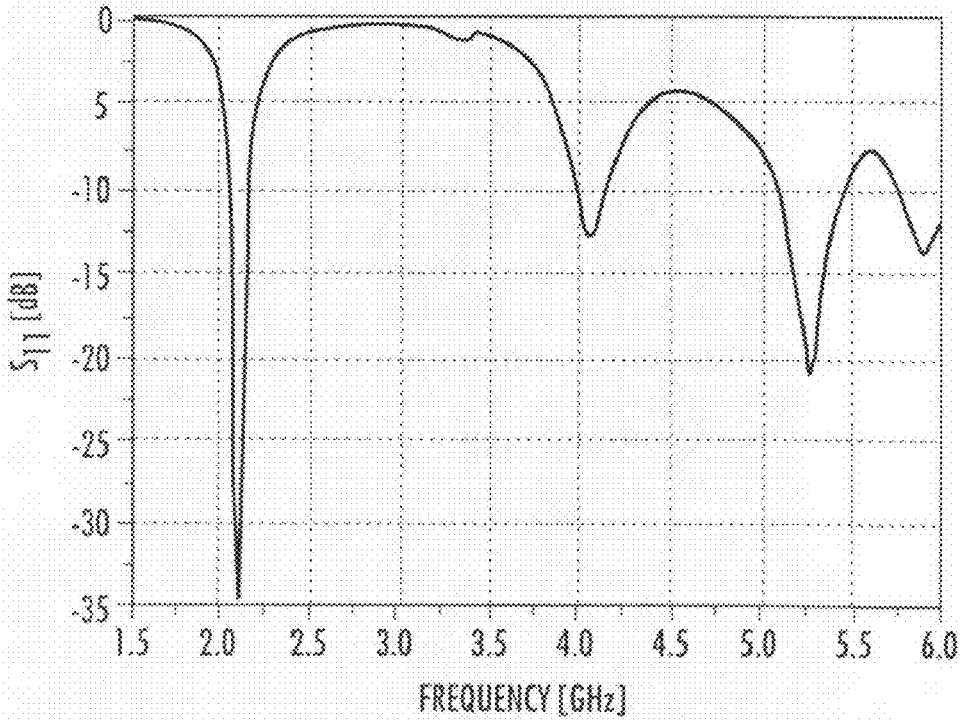
FIG. 11 is a graph of return loss vs. frequency associated with a third feed point of the antenna of FIG. 3.
Figure 12:
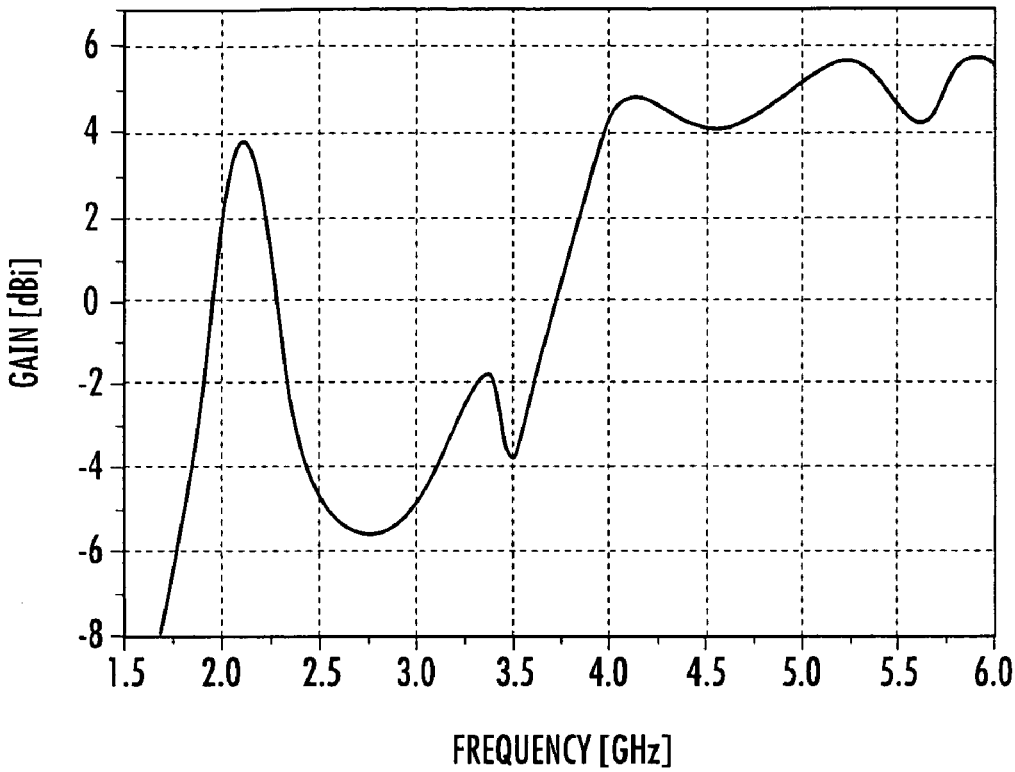
FIG. 12 is a graph of gain vs. frequency associated with the third feed point of the antenna of FIG. 3.
Figure 13A:
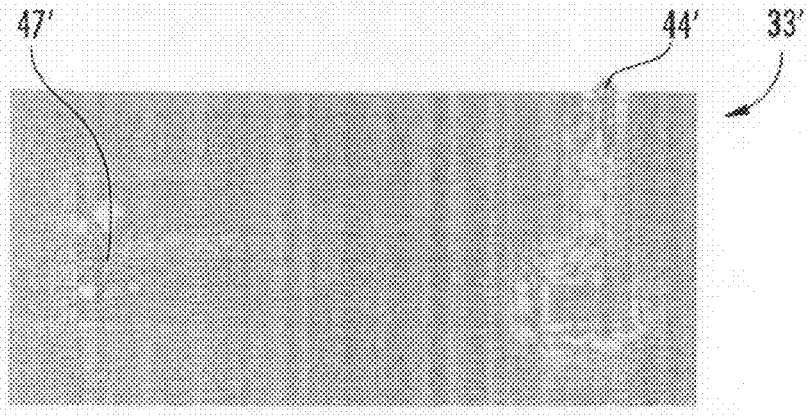
FIGS. 13A-13C are top views of the antenna of FIG. 3 illustrating simulated current distributions at 2.1 GHz, 5.2 GHz, and 5.8 GHz, respectively, using the third signal feed point.
Figure 13B:
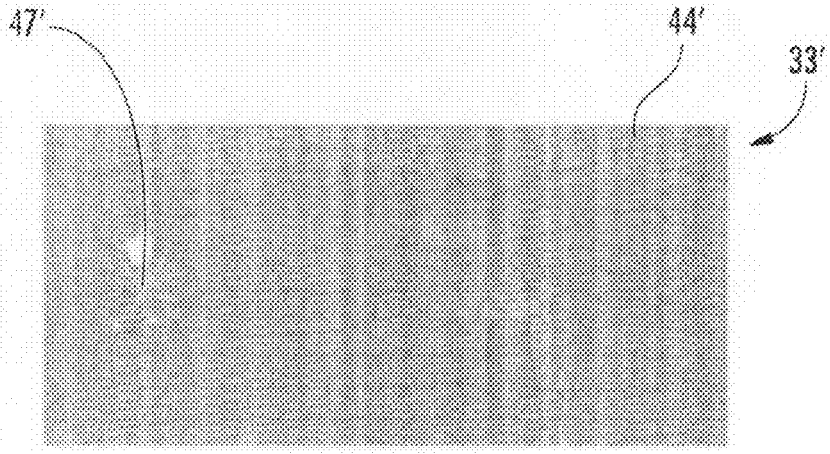
Figure 13C:
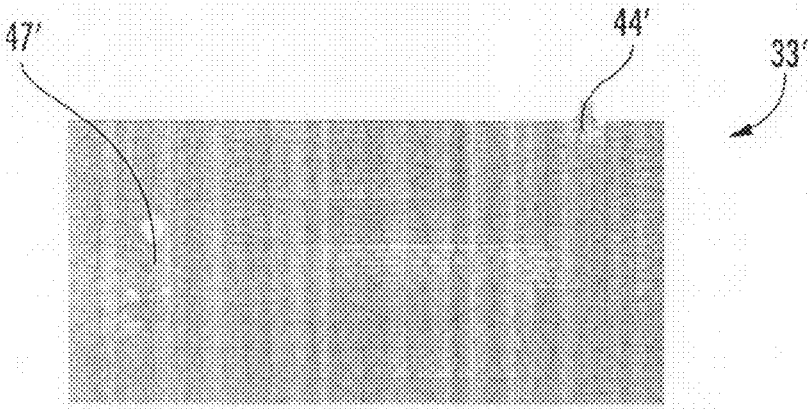
Figure 14A:
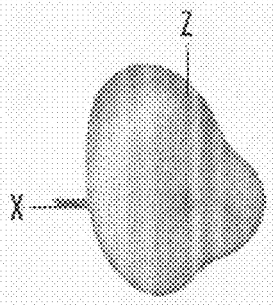
FIGS. 14A-14C are graphs of simulated antenna radiation patterns for the antenna of FIG. 3 at 2.1 GHz, 5.2 GHz, and 5.8 GHz, respectively, using the third signal feed point.
Figure 14B:
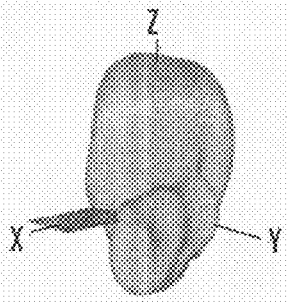
Figure 14C:
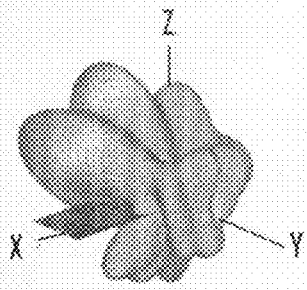
Figure 15:
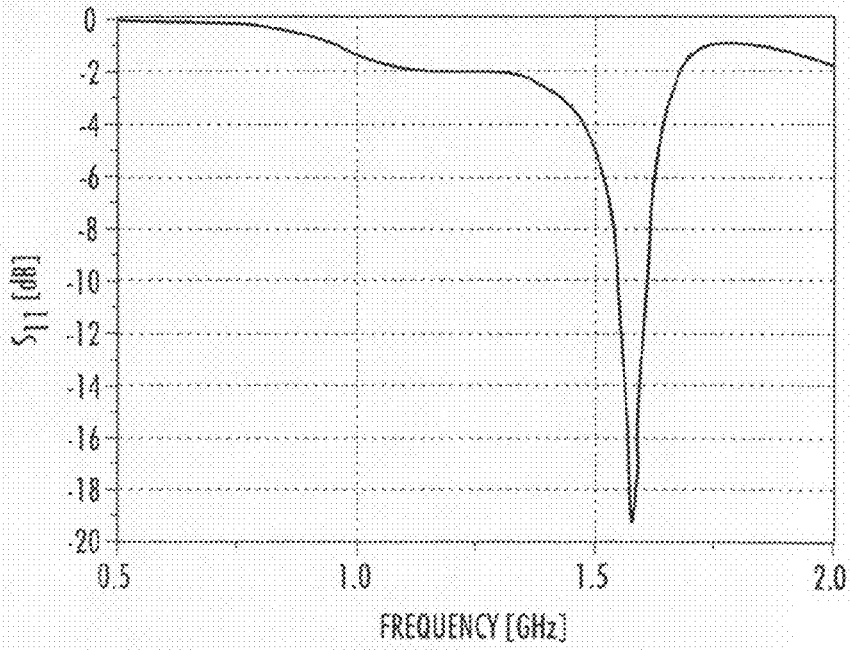
FIG. 15 is a graph of return loss vs. frequency associated with a fourth feed point of the antenna of FIG. 3.
Figure 16:
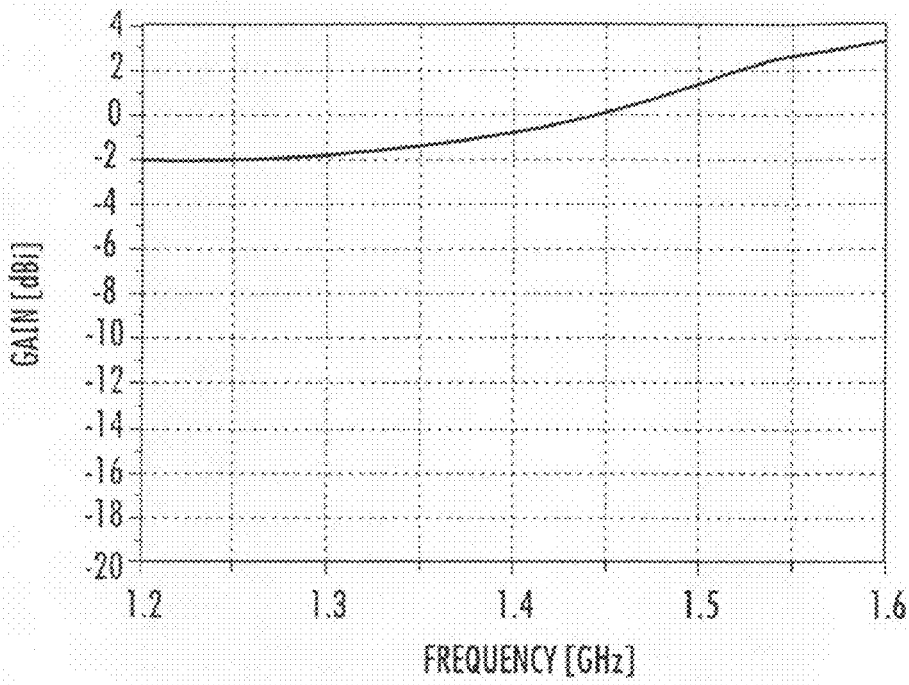
FIG. 16 is a graph of gain vs. frequency associated with the fourth feed point of the antenna of FIG. 3.
Figure 17:
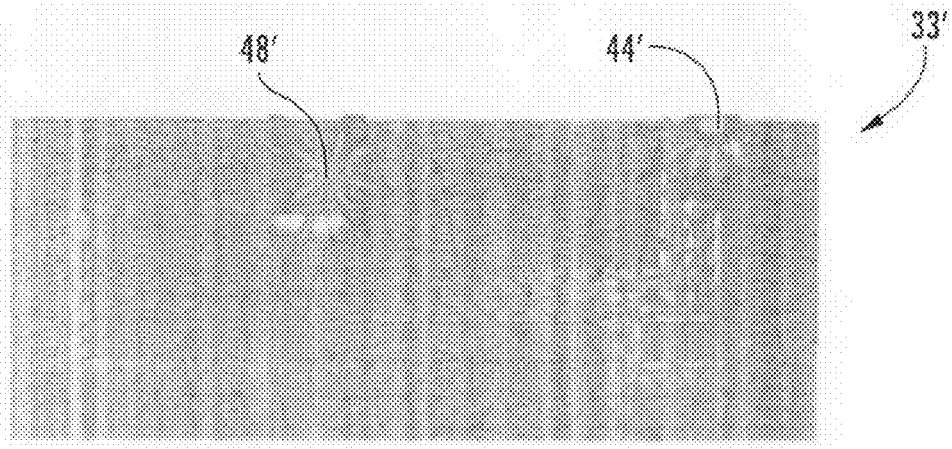
FIG. 17 is a top view of the antenna of FIG. 3 illustrating simulated current distribution at 1.54 GHz using the fourth signal feed point.
Figure 18:
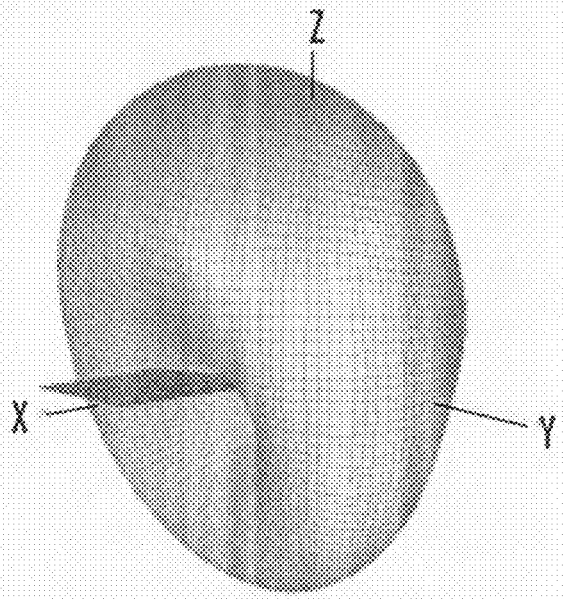
FIG. 18 is a graph of a simulated antenna radiation pattern for the antenna of FIG. 3 at 1.54 GHz using the fourth signal feed point.

The operating frequency characteristics associated with the first feed point 45 are illustrated in FIGS. 3-6. More particularly, in the exemplary configuration operation the antenna 33 is tuned to provide operation at 900 MHz, 1800 MHz, and 5 GHz via a selective connection of appropriate wireless RF transceivers 35 to the first feed point 45. First and second plots 50, 51 of simulated return loss vs. frequency for first and second simulations are shown in FIG. 3, and a simulated gain vs. frequency plot is shown in FIG. 4, The simulated current distributions across the patch antenna 33 at the above-noted frequencies are shown in FIGS. 5A-5C respectively, while the gain patterns for the frequencies are respectively shown in FIGS. 6A-6C.

The second feed point 46 is used for an operating frequency of 2.45 GHz. Simulated return loss vs. frequency, simulated gain vs. frequency, simulated current distribution, and simulated antenna radiation patterns associated with using the second feed point 46 at this frequency are shown in FIGS. 7, 6, 9, and 10, respectively. Similar to the first feed point 45, the third feed point 47 is also used for three operating frequency bands, which are 2.1 GHz, 5.2 GHz, and 5.8 GHz. Simulated return loss vs. frequency, simulated gain vs. frequency, simulated current distribution, and simulated antenna radiation patterns associated with using the third feed point 47 at these frequencies are shown in FIGS. 11, 12, 13A-13C, and 14A-14C, respectively. Furthermore, similar to the second feed point 46, the fourth feed point 48 is used for one operating frequency of 1.54 GHz. Simulated return loss vs. frequency, simulated gain vs. frequency, simulated current distribution, and simulated antenna radiation patterns associated with using the third feed point 48 at this frequency are shown in FIGS. 15, 16, 17, and 18, respectively.

Other exemplary components which may be included in the above-described device 30 are now generally discussed with reference to a hand-held mobile wireless communications device 1000 shown in FIG. 19. The device 1000 illustratively includes a housing 1200, a keypad 1400 and an output device 1600. The output device shown is a display 1600, which is preferably a full graphic LCD. Other types of output devices may alternatively be utilized. A processing device 1800 is contained within the housing 1200 and is coupled between the keypad 1400 and the display 1600. The processing device 1800 controls the operation of the display 1600, as well as the overall operation of the mobile device 1000, in response to actuation of keys on the keypad 1400 by the user.

The housing 1200 may be elongated vertically, or may take on other sizes and shapes (including clamshell housing structures). The keypad may include a mode selection key, or other hardware or software for switching between text entry and telephony entry.

Figure 19:
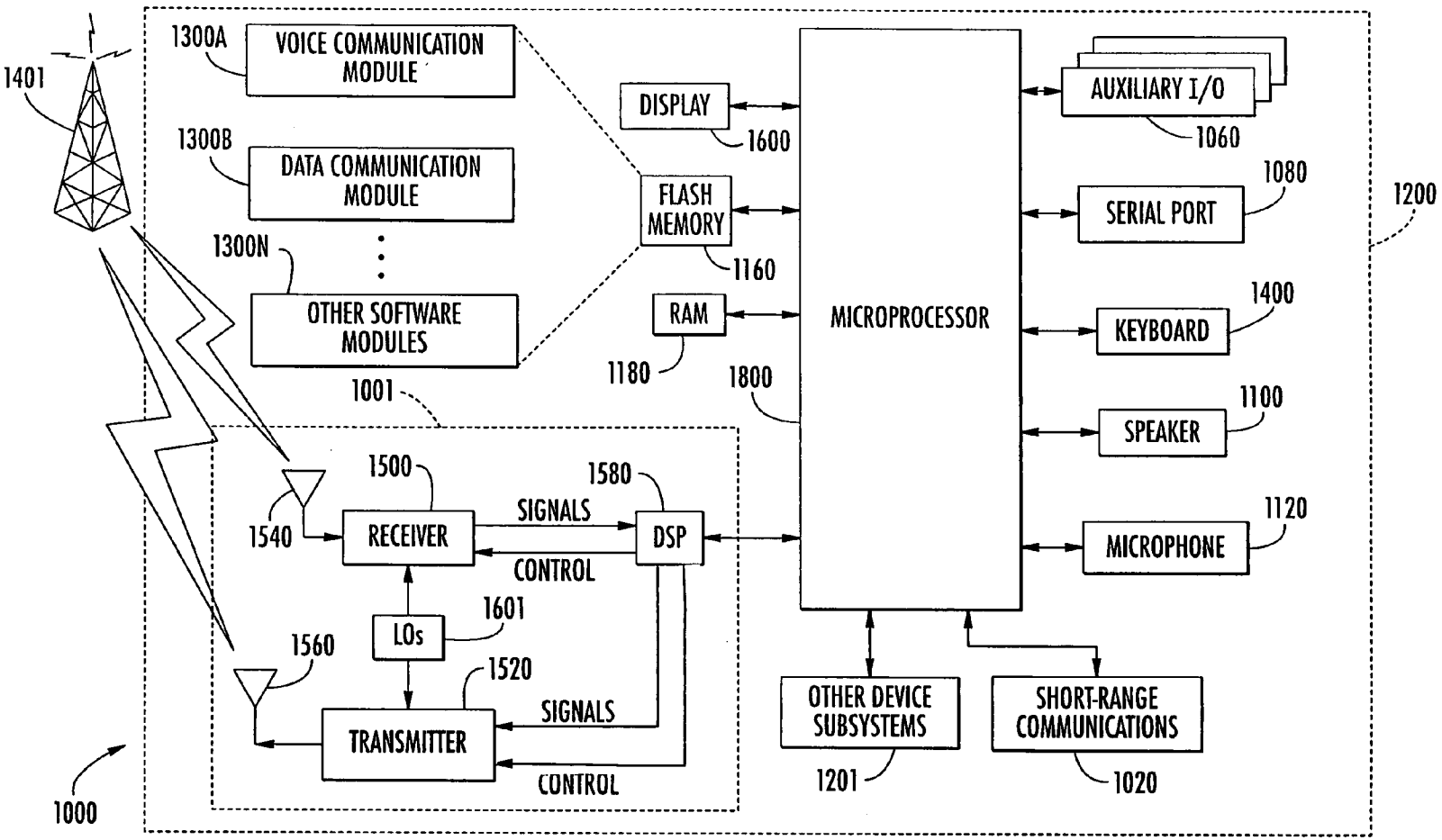
FIG. 19 is a schematic block diagram illustrating exemplary components for use in the mobile wireless communications device of FIG. 1.

In addition to the processing device 1800, other parts of the mobile device 1000 are shown schematically in FIG. 19. These include a communications subsystem 1001; a short-range communications subsystem 1020; the keypad 1400 and the display 1600, along with other input/output devices 1060, 1080, 1100 and 1120; as well as memory devices 1160, 1180 and various other device subsystems 1201. The mobile device 1000 is preferably a two-way RF communications device having voice and data communications capabilities. In addition, the mobile device 1000 preferably has the capability to communicate with other computer systems via the Internet.

Operating system software executed by the processing device 1800 is preferably stored in a persistent store, such as the flash memory 1160, but may be stored in other types of memory devices, such as a read only memory (ROM) or similar storage element. In addition, system software, specific device applications, or parts thereof, may be temporarily loaded into a volatile store, such as the random access memory (RAM) 1180. Communications signals received by the mobile device may also be stored in the RAM 1180.

The processing device 1800, in addition to its operating system functions, enables execution of software applications 1300A-1300N on the device 1000. A predetermined set of applications that control basic device operations, such as data and voice communications 1300A and 1300B, may be installed on the device 1000 during manufacture. In addition, a personal information manager (PIM) application may be installed during manufacture. The PIM is preferably capable of organizing and managing data items, such as e-mail, calendar events, voice mails, appointments, and task items. The PIM application is also preferably capable of sending and receiving data items via a wireless network 1401. Preferably, the PIM data items are seamlessly integrated, synchronized and updated via the wireless network 1401 with the device user's corresponding data items stored or associated with a host computer system.

Communication functions, including data and voice communications, are performed through the communications subsystem 1001, and possibly through the short-range communications subsystem. The communications subsystem 1001 includes a receiver 1500, a transmitter 1520, and one or more antennas 1540 and 1560. In addition, the communications subsystem 1001 also includes a processing module, such as a digital signal processor (DSP) 1580, and local oscillators (LOs) 1601. The specific design and implementation of the communications subsystem 1001 is dependent upon the communications network in which the mobile device 1000 is intended to operate. For example, a mobile device 1000 may include a communications subsystem 1001 designed to operate with the Mobitex™, Data TAC™ or General Packet Radio Service (GPRS) mobile data communications networks, and also designed to operate with any of a variety of voice communications networks, such as AMPS, TDMA, CDMA, WCDMA, PCS, GSM, EDGE, etc. Other types of data and voice networks, both separate and integrated, may also be utilized with the mobile device 1000.

The mobile device 1000 may also be compliant with other communications standards such as 3GSM, 3GPP, UMTS, etc.

Network access requirements vary depending upon the type of communication system. For example, in the Mobitex and DataTAC networks, mobile devices are registered on the network using a unique personal identification number or PIN associated with each device. In GPRS networks, however, network access is associated with a subscriber or user of a device. A GPRS device therefore requires a subscriber identity module, commonly referred to as a SIM card, in order to operate on a GPRS network.

When required network registration or activation procedures have been completed, the mobile device 1000 may send and receive communications signals over the communication network 1401. Signals received from the communications network 1401 by the antenna 1540 are routed to the receiver 1500, which provides for signal amplification, frequency down conversion, filtering, channel selection, etc., and may also provide analog to digital conversion. Analog-to-digital conversion of the received signal allows the DSP 1580 to perform more complex communications functions, such as demodulation and decoding. In a similar manner, signals to be transmitted to the network 1401 are processed (e.g. modulated and encoded) by the DSP 1580 and are then provided to the transmitter 1520 for digital to analog conversion, frequency up conversion, filtering, amplification and transmission to the communication network 1401 (or networks) via the antenna 1560.

In addition to processing communications signals, the DSP 1580 provides for control of the receiver 1500 and the transmitter 1520. For example, gains applied to communications signals in the receiver 1500 and transmitter 1520 may be adaptively controlled through automatic gain control algorithms implemented in the DSP 1580.

In a data communications mode, a received signal, such as a text message or web page download, is processed by the communications subsystem 1001 and is input to the processing device 1800. The received signal is then further processed by the processing device 1800 for an output to the display 1600, or alternatively to some other auxiliary I/O device 1060. A device user may also compose data items, such as e-mail messages, using the keypad 1400 and/or some other auxiliary I/O device 1060, such as a touchpad, a rocker switch, a thumb-wheel, or some other type of input device. The composed data items may then be transmitted over the communications network 1401 via the communications subsystem 1001.

In a voice communications mode, overall operation of the device is substantially similar to the data communications mode, except that received signals are output to a speaker 1100, and signals for transmission are generated by a microphone 1120. Alternative voice or audio I/O subsystems, such as a voice message recording subsystem, may also be implemented on the device 1000. In addition, the display 1600 may also be utilized in voice communications mode, for example to display the identity of a calling party, the duration of a voice call, or other voice call related information.

The short-range communications subsystem enables communication between the mobile device 1000 and other proximate systems or devices, which need not necessarily be similar devices. For example, the short-range communications subsystem may include an infrared device and associated circuits and components, or a Bluetooth™ communications module to provide for communication with similarly-enabled systems and devices.

Many modifications and other embodiments will come to the mind of one skilled in the art having the benefit of the teachings presented in the foregoing descriptions and the associated drawings. Therefore, it is understood that various modifications and embodiments are intended to be included within the scope of the appended claims.

That which is claimed is:

1. A mobile wireless communications device comprising:

a housing;

a common antenna carried by said housing and having a plurality of spaced apart signal feed points thereon;

a plurality of wireless radio frequency (RF) transceivers carried by said housing and coupled to respective ones of the signal feed points of said common antenna, each wireless RF transceiver also having a respective different operating frequency associated therewith; and a controller selectively operating at least some of the wireless RF transceivers to use said common antenna at a same time.

2. The mobile wireless communications device of claim 1 further comprising a dielectric substrate carried within said housing; and wherein said common antenna comprises at least one conductive trace on said dielectric substrate.

3. The mobile wireless communications device of claim 1 wherein said common antenna also has a reference voltage point.

4. The mobile wireless communications device of claim 1 wherein said common antenna comprises a patch antenna having at least one slot therein.

5. The mobile wireless communications device of claim 4 wherein said patch antenna has a generally rectangular perimeter.

6. The mobile wireless communications device of claim 4 wherein the at least one slot comprises a plurality of slots defining an exterior common antenna portion and an interior common antenna portion therein.

7. The mobile wireless communications device of claim 6 wherein at least one of the signal feed points is on the interior common antenna portion.

8. The mobile wireless communications device of claim 6 wherein at least one of the signal feed points is on the exterior common antenna portion.

9. The mobile wireless communications device of claim 1 wherein at least one of said wireless RF transceivers comprises a cellular transceiver.

10. The mobile wireless communications device of claim 1 wherein the different operating frequencies are within a range of about 900 MHz to 6 GHz.

11. The mobile wireless communications device of claim 1 wherein the different operating frequencies have different user functions associated therewith.

12. The mobile wireless communications device of claim 11 wherein the different user functions comprise at least one of voice communication, email reception, email transmission, data reception, and data transmission.

13. A mobile wireless communications device comprising:

a housing;

a common antenna carried by said housing and comprising a patch antenna having at least one slot therein, said common antenna also having a plurality of spaced apart signal feed points and a reference voltage point thereon;

a plurality of wireless radio frequency (RF) transceivers carried by said housing and coupled to respective ones of the signal feed points of said common antenna, each wireless RF transceiver also having a respective different operating frequency associated therewith; and a controller selectively operating at least some of the wireless RF transceivers to use said common antenna at a same time.

14. The mobile wireless communications device of claim 13 further comprising a dielectric substrate carried within said housing; and wherein said common antenna comprises at least one conductive trace on said dielectric substrate.

15. The mobile wireless communications device of claim 13 wherein said at least one slot comprises a plurality of slots defining an exterior common antenna portion and an interior common antenna portion therein.

16. The mobile wireless communications device of claim 15 wherein at least one of the signal feed points is on the interior common antenna portion.

17. The mobile wireless communications device of claim 15 wherein at least one of the signal feed points is on the exterior common antenna portion.

18. The mobile wireless communications device of claim 13 wherein at least one of said wireless RF transceivers comprises a cellular transceiver.

19. A method for making a mobile wireless communications device comprising:

providing a housing with a common antenna carried thereby, the common antenna having a plurality of spaced apart signal feed points thereon;

coupling a plurality of wireless radio frequency (RF) transceivers also carried by the housing to respective ones of the signal feed points of the common antenna, each wireless RF transceiver also having a respective different operating frequency associated therewith; and coupling a controller to the plurality of wireless RF transceivers to selectively operate at least some of the wireless RF transceivers to use the common antenna at a same time.

20. The method of claim 19 wherein the common antenna comprises at least one conductive trace.

21. The method of claim 19 wherein the common antenna also has a reference voltage point.

22. The method of claim 19 wherein the common antenna comprises a patch antenna having at least one slot therein.

23. The method of claim 22 wherein the at least one slot comprises a plurality of slots defining an exterior common antenna portion and an interior common antenna portion therein.

24. The method of claim 22 wherein at least one of the signal feed points is on the interior common antenna portion, and at least one of the signal feed points is on the exterior common antenna portion.

25. The method of claim 19 wherein at least one of the wireless RF transceivers comprises a cellular transceiver.

* * * * *

UNITED STATES PATENT AND TRADEMARK OFFICE

CERTIFICATE OF CORRECTION

PATENT NO. : 7,369,092 B1
APPLICATION NO. : 11/551284
DATED : May 6, 2008
INVENTOR(S) : Wen et al.

It is certified that error appears in the above-identified patent and that said Letters Patent is hereby corrected as shown below:

| | |
|---|---|
| Column 1, Line 39 | Delete: "so to"<br>Insert: --so too-- |
| Column 4, Line 12 | Delete: "EF"<br>Insert: --RF-- |
| Column 4, Line 15 | Delete "PCS"<br>Insert: --PCB-- |
| Column 5, Line 33 | Delete: "FIG. 4,"<br>Insert: --FIG. 4.-- |
| Column 5, Line 43 | Delete: "FIGS. 7, 6, 9"<br>Insert: --FIGS. 7, 8, 9-- |

Signed and Sealed this

Second Day of September, 2008

JON W. DUDAS
*Director of the United States Patent and Trademark Office*